US006394747B1

(12) United States Patent
Hablanian

(10) Patent No.: US 6,394,747 B1
(45) Date of Patent: May 28, 2002

(54) MOLECULAR DRAG VACUUM PUMPS

(75) Inventor: Marsbed Hablanian, Wellesley, MA (US)

(73) Assignee: Varian, Inc., Palo Alto, CA (US)

( * ) Notice: Subject to any disclaimer, the term of this patent is extended or adjusted under 35 U.S.C. 154(b) by 0 days.

(21) Appl. No.: 09/599,044

(22) Filed: Jun. 21, 2000

(51) Int. Cl.[7] ..... F04D 1/04

(52) U.S. Cl. ..... 415/55.1; 415/90

(58) Field of Search ..... 415/55.1, 90

(56) References Cited

U.S. PATENT DOCUMENTS

| | | | | | |
|---|---|---|---|---|---|
| 2,954,157 | A | * | 9/1960 | Eckberg | 415/90 |
| 3,104,802 | A | * | 9/1963 | Eckberg | 415/90 |
| 3,829,270 | A | * | 8/1974 | DeBonth et al. | 415/90 |
| 4,255,081 | A | * | 3/1981 | Oklejas et al. | 415/90 |
| 4,668,160 | A | | 5/1987 | Mase et al. | |
| 5,238,362 | A | | 8/1993 | Casaro et al. | |
| 5,358,373 | A | | 10/1994 | Hablanian | |
| 5,695,316 | A | | 12/1997 | Schutz et al. | |

OTHER PUBLICATIONS

Article by Tu et al., entitled "A New Design For The Disk–Type Molecular Pump", published in the Journal of Vacuum Science and Technology: Part A, American Institute of Physics, New York, US, No. 5, Sep./Oct. (1990).

* cited by examiner

*Primary Examiner*—John Kwon
(74) *Attorney, Agent, or Firm*—Bella Fishman

(57) ABSTRACT

Vacuum pumping apparatus includes a rotor, a motor for rotating the rotor about an axis of rotation, a stator mounted in proximity to the rotor and a housing enclosing the rotor and the stator. The stator includes at least one spiral channel having an open side facing the rotor. The housing defines an inlet in fluid communication with the inner portion of the spiral channel. Gas is pumped outwardly with respect to the axis of rotation through the spiral channel as the motor rotates the rotor. The stator may include two or more spiral channels coupled in parallel. The spiral channels may decrease in cross-sectional area from larger at the inner portion of the stator to smaller at the outer portion of the stator. The vacuum pumping apparatus may include a second vacuum pumping stage on a second side of the rotor and a series connection between the first and second vacuum pumping stages. The second vacuum pumping stage may have a variety of different configurations.

24 Claims, 6 Drawing Sheets

MOLECULAR DRAG VACUUM PUMPS

FIELD OF THE INVENTION

This invention relates to vacuum pumps and, more particularly, to molecular drag vacuum pump structures.

BACKGROUND OF THE INVENTION

Molecular drag vacuum pumps produce pumping action by momentum transfer from a fast-moving surface directly to gas molecules. A typical molecular drag vacuum pump includes a rotating element, or rotor, and a stationary element, or stator. The stator is provided with a channel between an inlet and an outlet. Collisions of gas molecules with the moving rotor cause gas in the channel to be pumped from the inlet to the outlet. In order to obtain a significant pressure ratio, the pressure should be relatively low, i.e., molecular flow conditions at least at the pump inlet, and the rotor velocity should approach the average velocity of the gas molecules.

Molecular drag vacuum pumps may be utilized in combination with other types of vacuum pumps. A vacuum pump utilizing turbomolecular vacuum pumping stages and molecular drag stages is disclosed in U.S. Pat. No. 5,238,362, issued Aug. 24, 1993 to Casaro et al.

One known type of molecular drag vacuum pump is the so-called Siegbahn-type pump. The Siegbahn-type pump is characterized by a rotor in the form of a disk and stator having a spiral channel that extends from the outer periphery of the disk toward the hub or center portion of the rotating disk. In the conventional Siegbahn-type pump, the inlet is at the outer periphery of the disk and the outlet or exhaust is located near the center of the disk. This arrangement was utilized because it is better for both pumping speed and compression ratio to have a high relative velocity between the rotor and the stationary pumping channel. The highest velocity of a rotating disk is achieved at its outer periphery.

In some applications, pumping speed and compression ratio are less important than small size and light weight. Accordingly, there is a need for improved molecular drag vacuum pump configurations.

SUMMARY OF THE INVENTION

According to a first aspect of the invention, vacuum pumping apparatus is provided. The vacuum pumping apparatus comprises a rotor, a motor for rotating the rotor about an axis of rotation, a stator mounted in proximity to the rotor, the stator including at least one spiral channel having an open side facing said rotor, and a housing enclosing the rotor and the stator. The housing defines an inlet in fluid communication with the spiral channel at the inner portion of the stator. Gas is pumped outwardly with respect to the axis of rotation through the spiral channel as the motor rotates the rotor.

The rotor may comprise a disk. The spiral channel may decrease in cross-sectional area from larger at the inner portion of the stator to smaller at the outer portion of the stator.

In one embodiment, the stator comprises two or more spiral channels coupled in parallel between the inlet and the outer portion of the stator. Each of the two or more spiral channels may decrease in cross-sectional area from larger at the inner portion of the stator to smaller at the outer portion of the stator.

The at least one spiral channel may define a first vacuum pumping stage on a first side of the rotor. The apparatus may further comprise a second vacuum pumping stage on a second side of the rotor and a series connection between the first and second vacuum pumping stages. In a first configuration, the second vacuum pumping stage comprises a molecular drag vacuum pumping stage having a second stage stator that defines at least one spiral channel. In a second configuration, the second vacuum pumping stage comprises a molecular drag vacuum pumping stage having a second stage rotor that defines two or more channels. The two or more channels may be connected in series or in parallel. The two or more channels may have spiral configurations or concentric circular configurations. In a third configuration, the second vacuum pumping stage comprises at least one regenerative vacuum pumping stage. In the regenerative vacuum pumping stage, the rotor may be provided with radial ribs or blades which define cavities.

According to another feature of the invention, the motor may comprise a pancake-type motor having a generally disk-shaped rotor. The disk-shaped rotor of the pancake-type motor may function as the rotor of a third vacuum pumping stage.

According to another aspect of the invention, vacuum pumping apparatus is provided. The vacuum pumping apparatus comprises a rotor in the form of a disk, a motor for rotating the disk about an axis of rotation, a first stator mounted in proximity to a first side of the disk, and a second stator mounted in proximity to a second side of the disk. The first stator defines a first channel configuration between an inner portion of the first stator near the axis and an outer portion of the first stator. The first channel configuration has an inlet at or near the inner portion of the first stator and comprises at least one spiral channel having a cross section that decreases from larger near the inlet to smaller near the outer portion of the first stator. The second stator defines a second channel configuration between the outer portion of the second stator and the inner portion of the second stator near the axis. The second channel configuration has an outlet at or near the inner portion of the second stator. The vacuum pumping apparatus further comprises a series connection between the first channel configuration and the second channel configuration. Gas is pumped outwardly with respect to the axis of rotation through the first channel configuration as the motor rotates the disk.

According to a further aspect of the invention, vacuum pumping apparatus is provided. The vacuum pumping apparatus comprises a first vacuum pumping stage having an inlet, a second vacuum pumping stage having an outlet, and a conduit for connecting the first and second vacuum pumping stages in series. The first vacuum pumping stage comprises a rotor, a motor for rotating the rotor about an axis of rotation, and a stator having at least one spiral channel between an inner portion of the stator and an outer portion of the stator. The inlet is connected to the at least one spiral channel at the inner portion of the stator. Gas is pumped outwardly with respect to the axis of rotation through the at least one spiral channel as the motor rotates the rotor.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
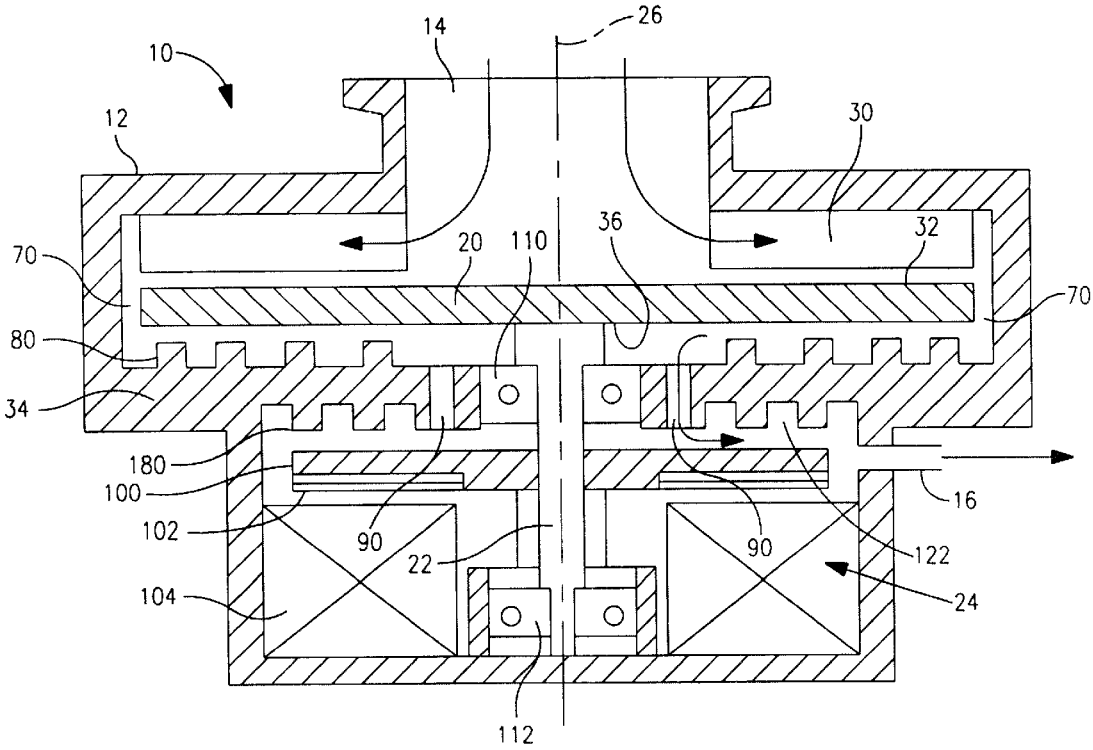
FIG. 1 is a cross-sectional view of vacuum pumping apparatus in accordance with a first embodiment of the invention.

Vacuum pumping apparatus 10 in accordance with a first embodiment of the invention is shown in FIGS. 1–4, where like elements have the same reference numerals. A housing 12 has an inlet 14 and an outlet 16. A rotor 20 is coupled by a shaft 22 to a motor 24. When motor 24 is energized, rotor 20 is rotated about an axis of rotation 26. In the embodiment of FIG. 1, rotor comprises a disk.

Vacuum pumping apparatus 10 further includes a fixed stator. The stator includes a first stage stator 30, located in close proximity to an upper surface 32 of rotor 20, and a second stage stator 34, located in close proximity to a lower surface 36 of rotor 20. The first stage stator 30 and a the second stage stator 34 may be integral parts of housing 12 or may be separate elements. Depending on the configuration, housing 12, either alone or in combination with the stator, forms a sealed enclosure having inlet 14 and outlet 16. The first stage stator 30 and the upper surface 32 of rotor 20 constitute a first stage of vacuum pumping apparatus 10; and the second stage stator 34 and the lower surface 36 of rotor 20 constitute a second stage of vacuum pumping apparatus 10.

Figure 2:
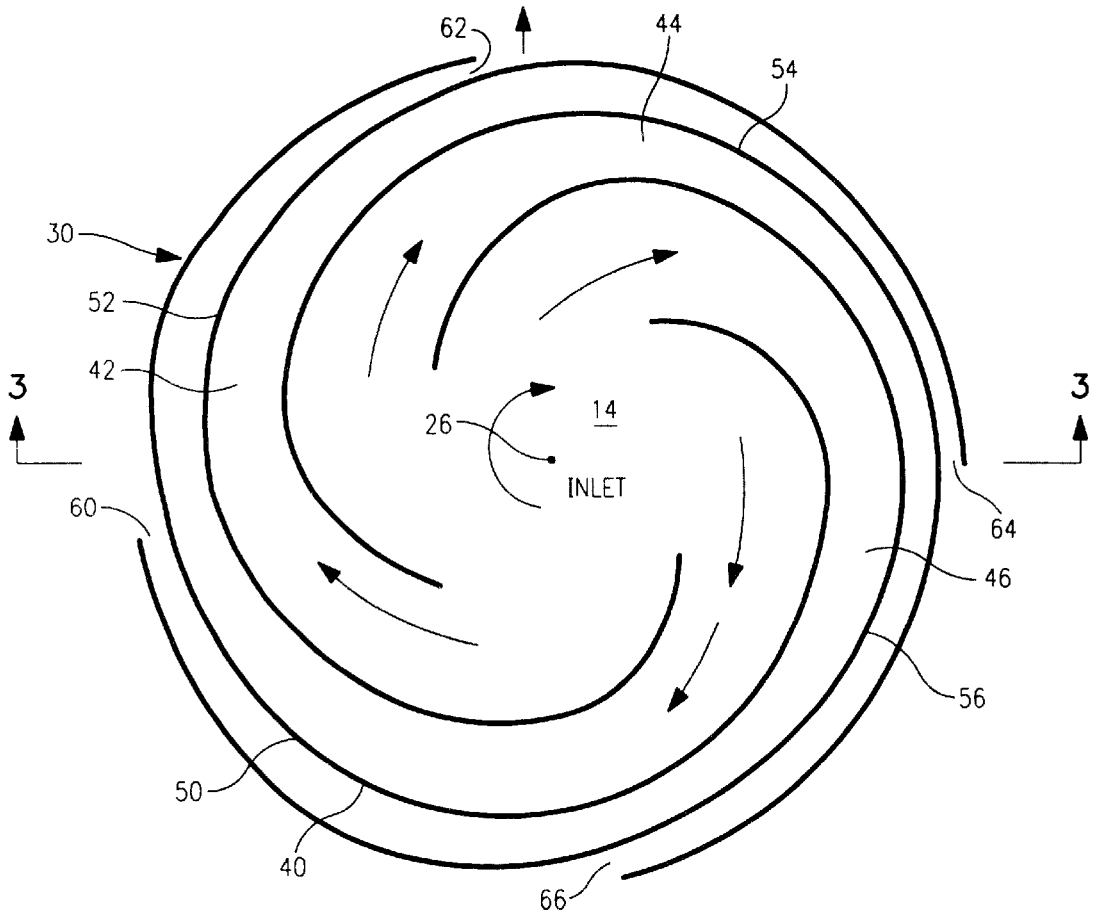
FIG. 2 is a cross-sectional view of the vacuum pumping apparatus of FIG. 1, showing a bottom view of the first stage stator.
Figure 3:
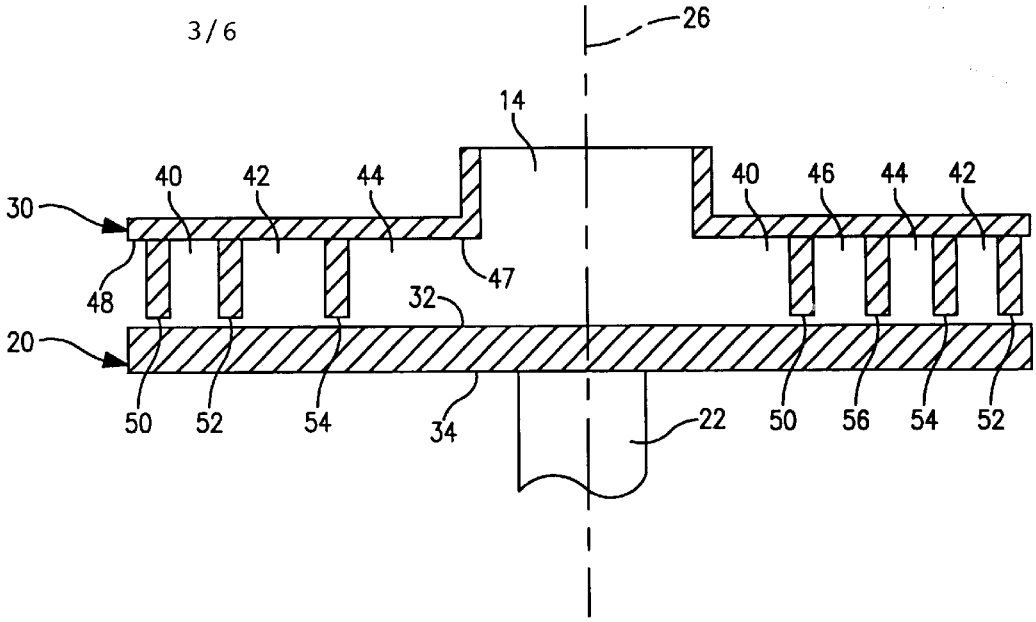
FIG. 3 is a cross-sectional side view of the first stage stator.

An example of first stage stator 30 is shown in FIGS. 2 and 3. First stage stator 30 defines one or more spiral channels which have open sides facing rotor 22. In the example of FIG. 2, first stage stator 30 includes four spiral channels 40, 42, 44 and 46 located between and defined by spiral ribs 50, 52, 54 and 56. Spiral channels 40, 42, 44 and 46 extend from an inner portion 47 of stator 30 near axis of rotation 26 to an outer portion 48 of stator 30. Spiral channels 40, 42, 44 and 46 provide parallel flow paths from the inner portion 47 of first stage stator 30 adjacent to inlet 14 to the outer portion 48 of first stage stator 30. Spiral channels 40, 42, 44 and 46 are separated by spiral ribs 50, 52, 54 and 56 of first stage stator 30. Ribs 50, 52, 54 and 56 have edges located in close proximity to upper surface 32 of rotor 20. The spacing between ribs 50, 52, 54 and 56, and rotor 20 is preferably in a range of about 0.001 to 0.010 inch.

Preferably, spiral channels 40, 42, 44 and 46 have cross-sectional areas that decrease from larger adjacent to inlet 14 to smaller at the outer portion of first stage stator 30. The width and/or the depth of spiral channels 40, 42, 44 and 46 may be varied in order to vary their cross-sectional areas.

As noted above, first stage stator 30 may have one or more spiral channels that extend from an inner portion of stator 30 near axis of rotation 26 to an outer portion of stator 30. The term "spiral" channel is intended to include any curved channel, including a spiral shaped channel formed by straight line segments, that extends from the inner portion of first stage stator 30 to the outer portion thereof. Each spiral channel may have more than one turn or less than one turn around axis 26.

In operation, rotor 20 is rotated at high speed by motor 24, typically in a range of 10,000 to 100,000 RPM, depending on the rotor diameter. Gas enters spiral channels 40, 42, 44 and 46 through inlet 14. The rotation of rotor 20 causes gas molecules colliding with rotor 20 to be pumped outwardly with respect to axis 26 through spiral channels 40, 42, 44 and 46 to the outer portion of first stage stator 30. The gas exits from spiral channels 40, 42, 44 and 46 through discharges 60, 62, 64 and 66 near the outer periphery of rotor 20.

As shown in FIG. 1, a passage 70 is provided between the outer periphery of rotor 20 and housing 12. Passage 70 provides a fluid connection between upper surface 32 and lower surface 36 of rotor 20. Gas discharged from the first stage of vacuum pumping apparatus 10 enters the second stage in a series connection.

Figure 4:
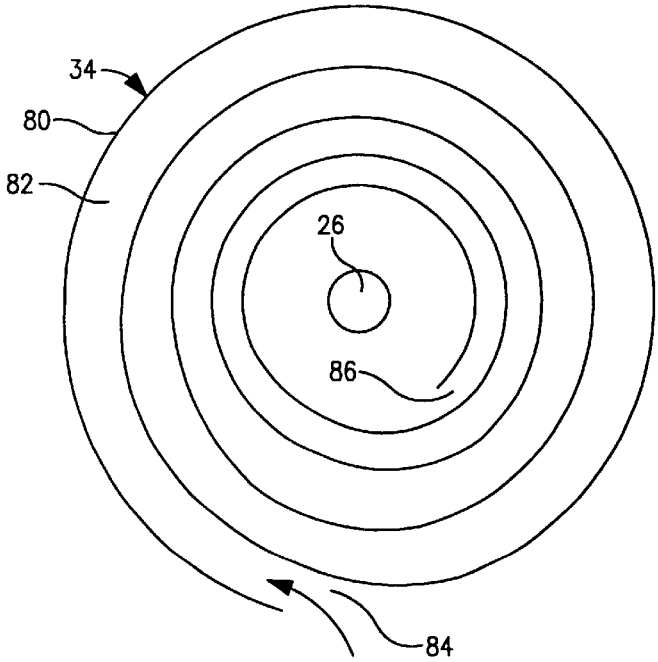
FIG. 4 is a cross-sectional view of the vacuum pumping apparatus of FIG. 1, showing a top view of the second stage stator.

An example of a suitable configuration of second stage rotor 34 is shown in FIG. 4. A spiral rib 80 defines a spiral channel 82 that extends from an inlet 84 at an outer portion of second stage stator 34 to a discharge 86 at an inner portion of second stage stator 34 near axis of rotation 26. An edge of spiral rib 80 is located in close proximity to the lower surface 36 of rotor 20, as shown in FIG. 1. Preferably, spiral channel 82 decreases in cross-sectional area from larger near inlet 84 to smaller near discharge 86. The width and/or the depth of spiral channel 82 may be varied in order to vary its cross-sectional area.

In operation, gas is pumped through spiral channel 82 from inlet 84 at the outer portion of stator 34 to the discharge 86 at the inner portion of stator 30, as rotor 20 rotates at high speed. As indicated above, collisions of gas molecules in channel 82 with moving rotor 20 cause the gas molecules to be pumped inwardly with respect to axis 26 through channel 82. The gas pumped through spiral channel 82 may be discharged through openings 90 in second stage stator 34. In one embodiment, the second stage discharges through openings 90 to atmosphere or to another vacuum pumping device. In another embodiment, vacuum pumping apparatus 10 is provided with a third stage as described below.

In one configuration of vacuum pumping apparatus 10, motor 24 may be a pancake-type motor as shown in FIG. 1. In this configuration, motor 24 includes a disc-shaped rotor 100 containing magnetic material 102 and a stationary winding 104. Winding 104 is positioned in proximity to magnetic material 102, and rotor 100 is affixed to shaft 22. When stationary winding 104 is energized by an electrical current, rotor 100 is caused to rotate about axis 26, thereby rotating shaft 22 and rotor 20. Shaft 22 may be mounted in bearings 110 and 112 for rotation about axis 26. The pancake-type motor configuration of FIG. 1 permits pumping apparatus 10 to have a relatively short axial length.

According to an additional feature of vacuum pumping apparatus 10, rotor 100 of the pancake-type motor may be utilized as the rotor of a third stage of vacuum pumping apparatus 10. As shown in FIG. 1, a third stage stator 120, located in close proximity to rotor 100, defines one or more channels 122 which extend from opening 90 near axis 26 to outlet 16. The one or more channels 122 may be circular or spiral. Third stage stator 120 and rotor 100 constitute a third stage.

Figure 6:
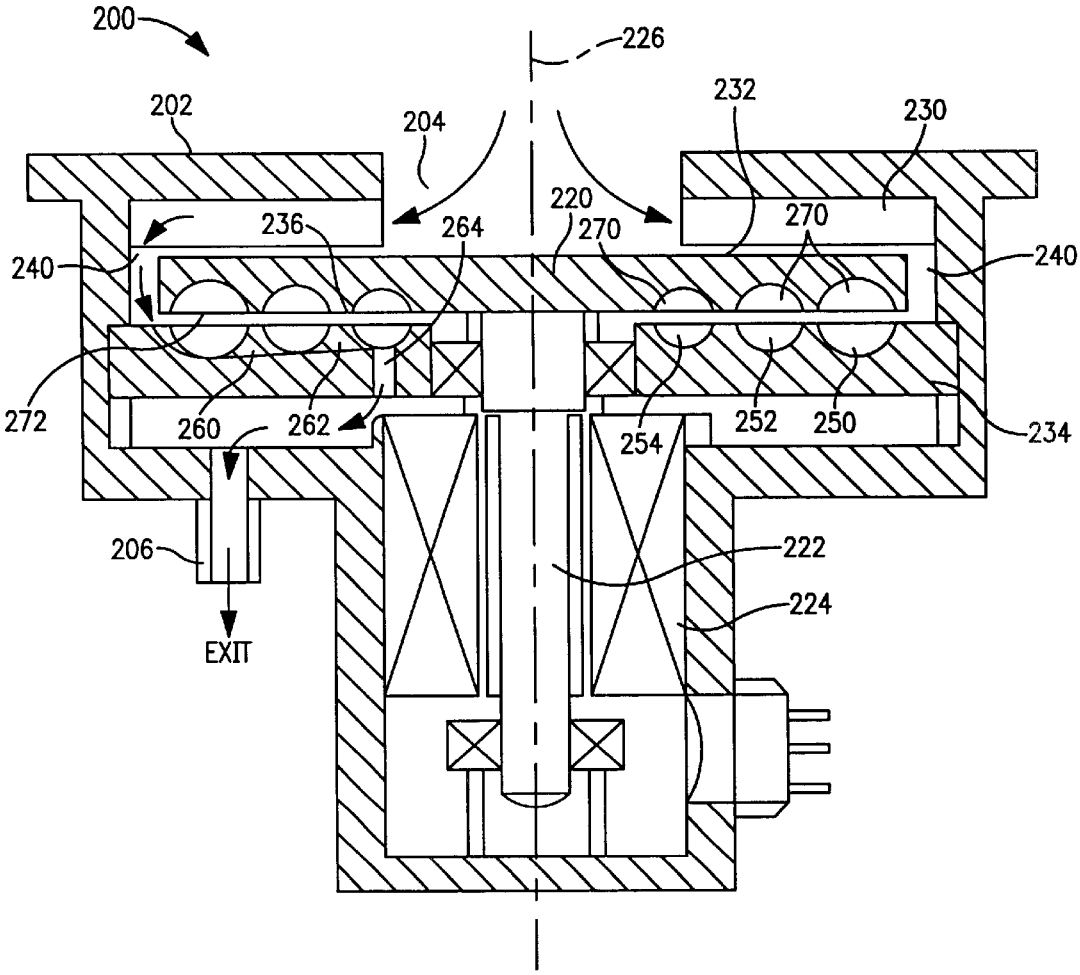
FIG. 6 is a cross-sectional view of vacuum pumping apparatus in accordance with a second embodiment of the invention.

In a second motor configuration, shaft 22 is mechanically coupled to a conventional motor of the type shown in FIG. 6, and the third stage of vacuum pumping apparatus 10 is not utilized.

Figure 5:
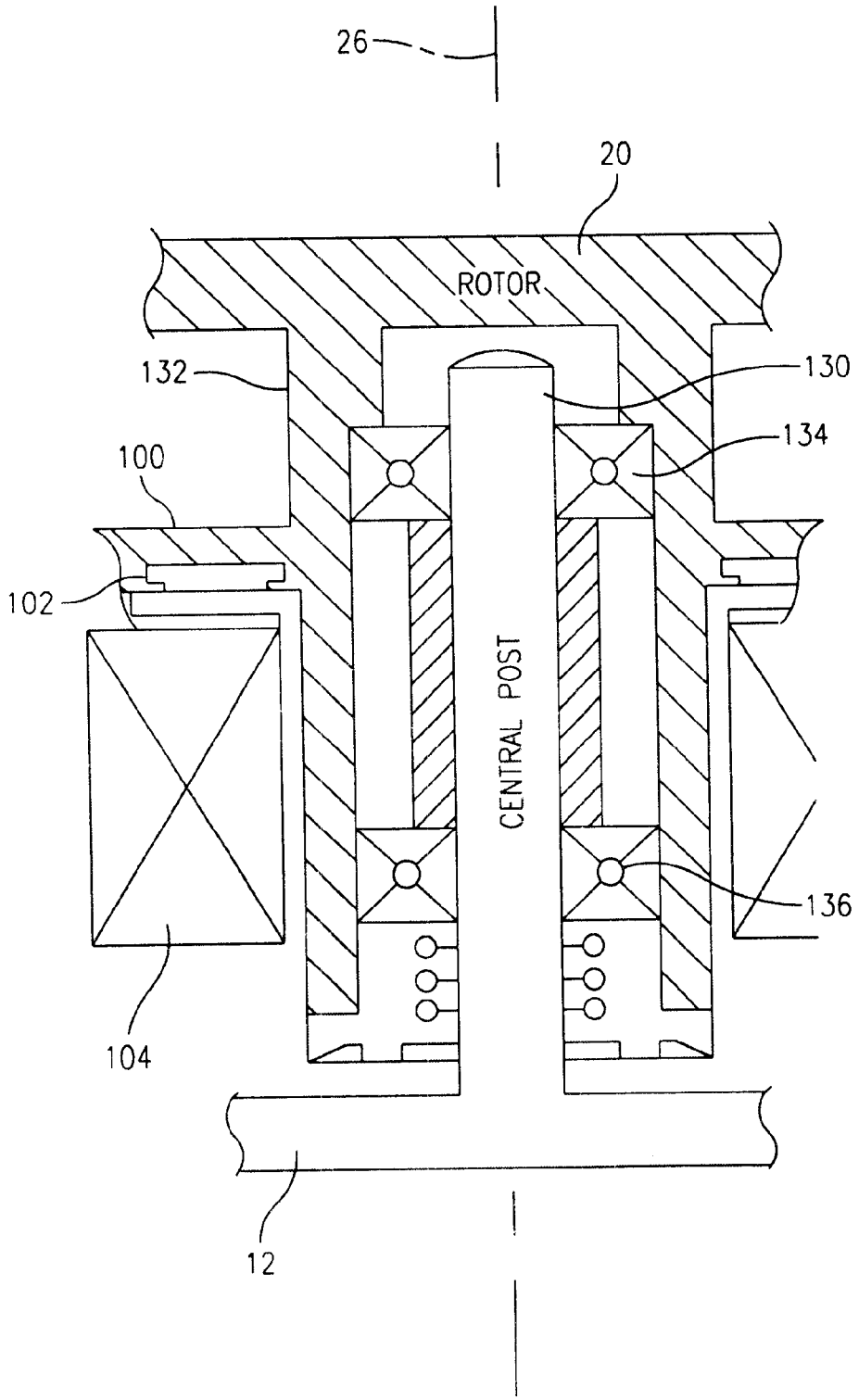
FIG. 5 is a partial cross-sectional view of vacuum pumping apparatus showing a second rotor configuration.

A second shaft configuration is shown in FIG. 5. A stationary post 130 is affixed to housing 12. A cylindrical shaft 132 is affixed to rotor 20, and post 130 is mounted within cylindrical shaft 132. Cylindrical shaft 132 is rotatably mounted to stationary post 130 by bearings 134 and 136.

Vacuum pumping apparatus 200 in accordance with a second embodiment of the invention is shown in FIG. 6. A housing 202 has an inlet 204 and an outlet 206. A rotor 220 is coupled by a shaft 222 to a motor 224. In the embodiment of FIG. 6, motor 224 has a conventional configuration. When motor 224 is energized, rotor 220 is rotated about an axis of rotation 226. A first stage stator 230 is located in close proximity to an upper surface 232 of rotor 220, and a second stage stator 234 is located in close proximity to a lower surface 236 of rotor 220. The first stage stator 230 and the upper surface 232 of rotor 220 constitute a first stage of vacuum pumping apparatus 200; and the second stage rotor 234 and the lower surface 236 of rotor 220 constitute a second stage of vacuum pumping apparatus 200.

The first stage of vacuum pumping apparatus 200 may be configured as described above in connection with the first stage of vacuum pumping apparatus 10 shown in FIGS. 1–4. In particular, first stage stator 230 may be provided with one or more spiral channels that extend from an inner portion of stator 230 to an outer portion of stator 230, so that gas is pumped outwardly with respect to axis 226 through the one or more spiral channels. A passage 240 is provided between the outer periphery of rotor 220 and housing 202. Passage 240 provides a series connection between the first and second stages of vacuum pumping apparatus 200.

The second stage of vacuum pumping apparatus 200 may be configured as a regenerative vacuum pumping stage. In particular, second stage stator 234 is provided with concentric circular channels 250, 252 and 254. Each channel is provided at one location around its circumference with a stripper or blockage. Channels 250 and 252 and connected by a passage 260, and channels 252 and 254 are connected by a passage 262. A passage 264 connects channel 254 to outlet 206. The lower surface 236 of rotor 220 is provided with circular patterns of cavities 270 defined by radial ribs 272. In the embodiment of FIG. 6, rotor 220 comprises a disk having a flat upper surface 236 and having cavities 270 in an otherwise flat lower surface 236. Additional information regarding regenerative vacuum pumping stages is disclosed in U.S. Pat. No. 5,358,373 issued Oct. 25, 1994 to Hablanian, which is hereby incorporated by reference.

In operation, gas is pumped from inlet 204 through the first stage as described above in connection with FIGS. 1–4. Gas is then pumped through passage 240 to the second stage, and then is pumped in succession through channels 250, 252 and 254 to outlet 206.

It will be understood that one or more of the channels in the second stage may be configured as molecular drag channels rather than regenerative channels. The cavities 270 in the lower surface 236 of rotor 220 are eliminated for the molecular drag channels. Additional information regarding molecular drag vacuum pumping stages is disclosed in the aforementioned Pat. No. 5,358,373.

Figure 7:
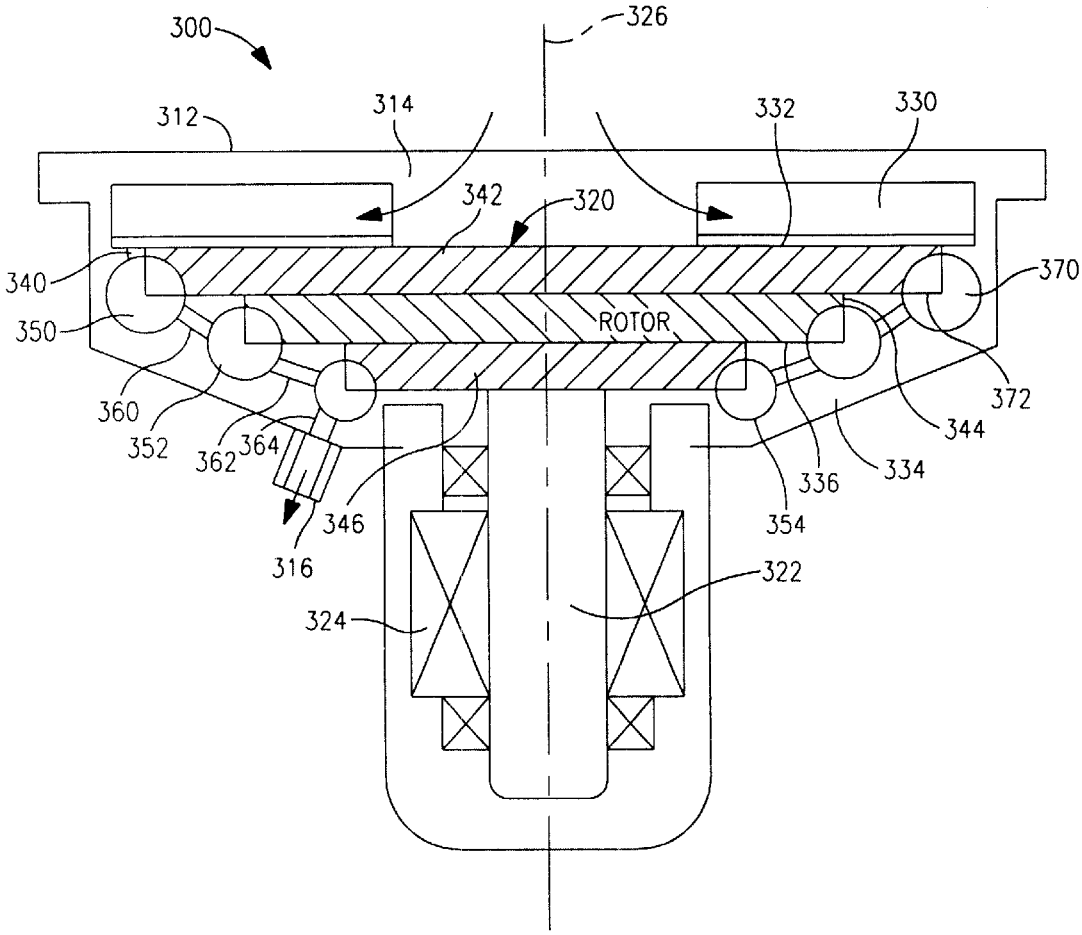
FIG. 7 is a cross-sectional view of vacuum pumping apparatus in accordance with a third embodiment of the invention.

Vacuum pumping apparatus 300 in accordance with a third embodiment of the invention is shown in FIG. 7. A housing 312 has an inlet 314 and an outlet 316. A rotor 320 is coupled by a shaft 322 to a motor 324. When motor 324 is energized, rotor 320 is rotated about an axis of rotation 326. A first stage stator 330 is located in close proximity to an upper surface 332 of rotor 320, and a second stage stator 334 is located in close proximity to a lower surface 336 of rotor 320. The first stage stator 330 and the upper surface 332 of rotor 330 constitute a first stage of vacuum pumping apparatus 300; and the second stage stator 334 and the lower surface 336 of rotor 320 constitute a second stage of vacuum pumping apparatus 300.

The first stage may be configured as described above in connection with the first stage of vacuum pumping apparatus 10 shown in FIGS. 1–4. In particular, first stage stator 330 may be provided with one or more spiral channels that extend from an inner portion of stator 330 to an outer portion of stator 330, so that gas is pumped outwardly with respect to axis 326 through the one or more spiral channels. A passage 340 is provided between the outer periphery of rotor 320 and housing 312. Passage 340 provides a series connection between the first stage and the second stage of vacuum pumping apparatus 300.

In the embodiment of FIG. 7, rotor 320 comprises disks 342, 344 and 346 of different diameters. Second stage stator 334 is provided with circular channels 350, 352 and 354 having diameters that correspond to the outside diameters of disks 342, 344 and 346, respectively. Each of the channels 350, 352 and 354 is provided with a stripper or blockage at one circumferential location. A passage 360 interconnects channel 350 and 352, and a passage 362 interconnects channels 352 and 354. A passage 364 connects channel 354 to outlet 316. Each of the disks 342, 344 and 346 is provided with a circular pattern of cavities 370 defined by radial ribs 372. The cavities are located on disks 342, 344 and 346 within the respective channels 350, 353 and 354. The disks 342, 344 and 346 and the adjacent channels 350, 352 and 354 constitute regenerative vacuum pumping channels.

In operation, gas is pumped through inlet 314 and through the one or more spiral channels in the first stage of vacuum pumping apparatus 300. The gas then is exhausted through passage 340 to the second stage and is pumped in succession through channels 350, 352 and 354 to outlet 316.

The vacuum pumping apparatus of the invention is shown in FIGS. 1 and 6 as comprising a single rotating disk with first and second stages connected in series. The second stage may have one or more spiral channels or may have one or more circular channels. Typically, the spiral channels are connected in parallel, and the circular channels are connected in series. The circular channels may comprise molecular drag pumping channels or regenerative pumping channels. It will be understood that the second stage may have any desired configuration that provides additional pumping capacity. Furthermore, the vacuum pumping apparatus may be configured with two or more rotating disks, each having one or more pumping channels on one or both sides. Each embodiment of the invention may utilize a conventional motor as shown in FIG. 6 or a pancake-type motor as shown in FIG. 1.

While there have been shown and described what are at present considered the preferred embodiments of the present invention, it will be obvious to those skilled in the art that various changes and modifications may be made therein without departing from the scope of the invention as defined by the appended claims.

What is claimed is:

1. Vacuum pumping apparatus comprising:

a rotor having a first and a second sides;

a motor for rotating said rotor about an axis of rotation;

a stator mounted in proximity to said rotor, said stator including at least one spiral channel having an open side facing said rotor and defining a first vacuum pumping stage on said first side that is connected in series to a second vacuum pumping stage defined on said second side; and a housing enclosing said rotor and said stator, said housing defining an inlet within a central portion of said housing being in fluid communication with said at least one spiral channel at an inner portion of said stator, wherein gas is pumped outwardly with respect to the axis of rotation through said at least one spiral channel as said motor rotates said rotor.

2. Vacuum pumping apparatus as defined in claim 1, wherein said at least one spiral channel decreases in cross-sectional area from larger at the inner portion of said stator to smaller at an outer portion of said stator.

3. Vacuum pumping apparatus as defined in claim 1, wherein said stator comprises two or more spiral channels coupled in parallel between said inlet and the outer portion of said stator.

4. Vacuum pumping apparatus as defined in claim 3, wherein said two or more spiral channels decrease in cross-sectional area from larger at the inner portion of said stator to smaller at an outer portion of said stator.

5. Vacuum pumping apparatus as defined in claim 1, wherein said second vacuum pumping stage comprises a molecular drag vacuum pumping stage having a second stage stator that defines at least one spiral channel.

6. Vacuum pumping apparatus as defined in claim 5, wherein the at least one spiral channel of said second vacuum pumping stage decreases in cross-sectional area from larger at an outer portion of said second stage stator to smaller at an inner portion of said second stage stator.

7. Vacuum pumping apparatus as defined in claim 1, wherein said second vacuum pumping stage comprises a molecular drag vacuum pumping stage having a second stage stator that defines two or more channels.

8. Vacuum pumping apparatus as defined in claim 7, wherein said two or more channels have spiral configurations and are coupled in parallel.

9. Vacuum pumping apparatus as defined in claim 8, wherein said two or more channels decrease in cross section from larger at an outer portion of said second stage stator to smaller at an inner portion of said second stage stators.

10. Vacuum pumping apparatus as defined in claim 1, wherein said second vacuum pumping stage comprises a regenerative vacuum pumping stage.

11. Vacuum pumping apparatus as defined in claim 10, wherein said regenerative vacuum pumping stage comprises a second stage stator that defines a circular channel, said rotor having a pattern of cavities aligned with said circular channel.

12. Vacuum pumping apparatus as defined in claim 1, wherein said rotor comprises a disk.

13. Vacuum pumping apparatus as defined in claim 1, wherein said motor comprises a pancake-type motor having a generally disk-shaped rotor.

14. Vacuum pumping apparatus as defined in claim 13, wherein the disk-shaped rotor of said pancake-type motor functions as the rotor of a third vacuum pumping stage.

15. Vacuum pumping apparatus comprising:

a rotor comprising a disk;

a motor for rotating said disk about an axis of rotation;

a first stator mounted in proximity to a first side of said disk, said first stator defining a first channel configuration between an inner portion of said first stator near said axis and an outer portion of said first stator, said first channel configuration having an inlet at or near the inner portion of said first stator and comprising at least one spiral channel having a cross section that decreases from larger near said inlet to smaller near the outer portion of said first stator;

a second stator mounted in proximity to a second side of said disk, said second stator defining a second channel configuration between an outer portion of said second stator and an inner portion of said second stator near said axis, said second channel configuration having an outlet at or near the inner portion of said second stator; and a series connection between the first channel configuration and the second channel configuration, wherein gas is outwardly with respect to the axis of rotation through said first channel configuration as said motor rotates said disk.

16. Vacuum pumping apparatus as defined in claim 15, wherein said first channel configuration comprises two or more spiral channels coupled in parallel between said inlet and the outer portion of said stator.

17. Vacuum pumping apparatus as defined in claim 16, wherein said two or more spiral channels decrease in cross-sectional area from larger at the inner portion of said first stator to smaller at the outer portion of said first stator.

18. Vacuum pumping apparatus as defined in claim 15, wherein said second stator defines at least one spiral channel.

19. Vacuum pumping apparatus as defined in claim 15, wherein said second stator defines two or more channels.

20. Vacuum pumping apparatus as defined in claim 19, wherein said two or more channels have spiral configurations and are coupled in parallel.

21. Vacuum pumping apparatus as defined in claim 19, wherein said two or more channels have concentric circular configurations and are coupled in series.

22. Vacuum pumping apparatus as defined in claim 15, wherein said second stator defines a circular channel and wherein said rotor includes a pattern of cavities aligned with said circular channel to form a regenerative vacuum pumping stage.

23. Vacuum pumping apparatus as defined in claim 15, wherein said motor comprises a pancake-type motor having a generally disk-shaped rotor.

24. Vacuum pumping apparatus comprising:

a first vacuum pumping stage having an inlet at a central portion of said first vacuum pumping stage, said first vacuum pumping stage comprising a rotor, a motor for rotating said rotor about an axis of rotation, and a stator having at least one spiral channel between an inner portion of said stator and an outer portion of said stator, wherein said inlet is connected to said at least one spiral channel at the inner portion of said stator and wherein gas is pumped outwardly with respect to the axis of rotation through said at least one spiral channel as said motor rotates said rotor;

a second vacuum pumping stage having an outlet; and a conduit for connecting said first and second vacuum pumping stages in series.

* * * * *